US006066017A

United States Patent [19]

Max et al.

[11] Patent Number: 6,066,017

[45] Date of Patent: May 23, 2000

[54] INFLATABLE, NONCOLLAPSIBLE, PERSONAL FLOTATION DEVICE

[75] Inventors: Michael D. Max, Washington, D.C.; Robert E. Pellenbarg, Silver Spring, Md.

[73] Assignee: The United States of America as represented by the Secretary of the Navy, Washington, D.C.

[21] Appl. No.: 09/042,363

[22] Filed: Jan. 29, 1998

[51] Int. Cl.[7] ..... B63C 9/15

[52] U.S. Cl. ..... 441/98; 521/917

[58] Field of Search ..... 441/98, 105, 106; 521/917

[56] References Cited

U.S. PATENT DOCUMENTS

| | | | |
|---|---|---|---|
| 4,263,412 | 4/1981 | Pauls | 521/114 |
| 4,424,043 | 1/1984 | Behl | 441/81 |
| 4,734,072 | 3/1988 | Lastnik | 441/105 |
| 5,098,325 | 3/1992 | Kim et al. | 441/88 |

*Primary Examiner*—Jesus D. Sotelo

*Attorney, Agent, or Firm*—Barry A. Edelberg; Charles J. Stockstill

[57] ABSTRACT

The inflatable, non-collapsible, flotation device (INCFD) utilizes foam making chemicals within a flotation chamber where the materials react and harden to form a layer of pliant foam, such as polyurethane. The foam, during reaction, conforms with the shape of the wearer and hardens to provide both flotation and physical protection from exterior objects.

11 Claims, 2 Drawing Sheets

INFLATABLE, NONCOLLAPSIBLE, PERSONAL FLOTATION DEVICE

BACKGROUND OF THE INVENTION

1. Field of the Invention

This invention pertains generally to personal flotation devices and more specifically to a personal flotation device wherein the flotation element is a pliant foam material that is formed within the flotation device upon activation by the user.

2. Description of the Related Art

Life jackets are personal flotation devices worn by an individual designed to support that person in any condition up to and including an unconscious state, with their face held above water. Two types of personal flotation devices that qualify as life jackets as defined are currently in use: inflatable and non-collapsible. Each of these configurations has advantages and disadvantages.

The advantages of the inflatable life jacket are that the device is stored in a deflated state and thus occupies a small storage space, allowing for stowage in critical areas and near hatches where bulky objects could constitute a hazard. Both manual and pressurized gas inflation are usually provided for the inflatable configuration. When inflated, these life jackets often fit closely to the body, especially when not fully inflated, and provide some insulation to the torso, the neck and back of the head. A main disadvantage with inflatable life jackets is that they can be punctured, in which case they provide no buoyancy, are an impediment to motion and are extra weight until jettisoned.

The primary advantage of the non-collapsible life jacket is that the device cannot be punctured and will provide a constant buoyancy, even if severely damaged. Some non-collapsible life jackets are also fire-resistant. The main disadvantage is that they require voluminous storage space and cannot be kept close to personnel where storage space is tight. Further, because their form is fixed, these jackets usually fit a wearer very imperfectly, often causing distress when fixed too tightly or when entering or exiting water. Critically, non-collapsible flotation devices provide little insulation in the water because of a usually poor fit.

SUMMARY OF THE INVENTION

The object of this invention is to provide a personal flotation device that combines the advantages of both the inflatable and non-collapsible flotation devices that is, upon inflation, capable of conforming to the complex shape of the human body.

Another object is to provide a device that, upon inflation, has a pliant solid foam flotation component and is light in weight with excellent flotation qualities.

These and other objectives are achieved by the inflatable, non-collapsible, flotation device (INCFD) where pliant foam making materials are injected into a buoyancy bag where the materials interact and harden to form a layer of pliant foam, i.e., especially polyurethane. The pliant foam, during inflation, conforms to the shape of the wearer and provides both flotation and physical protection from exterior objects.

Further, the form fitting nature of the pliant foam provides some insulation for the wearer.

DESCRIPTION OF THE PREFERRED EMBODIMENT

Figure 1:
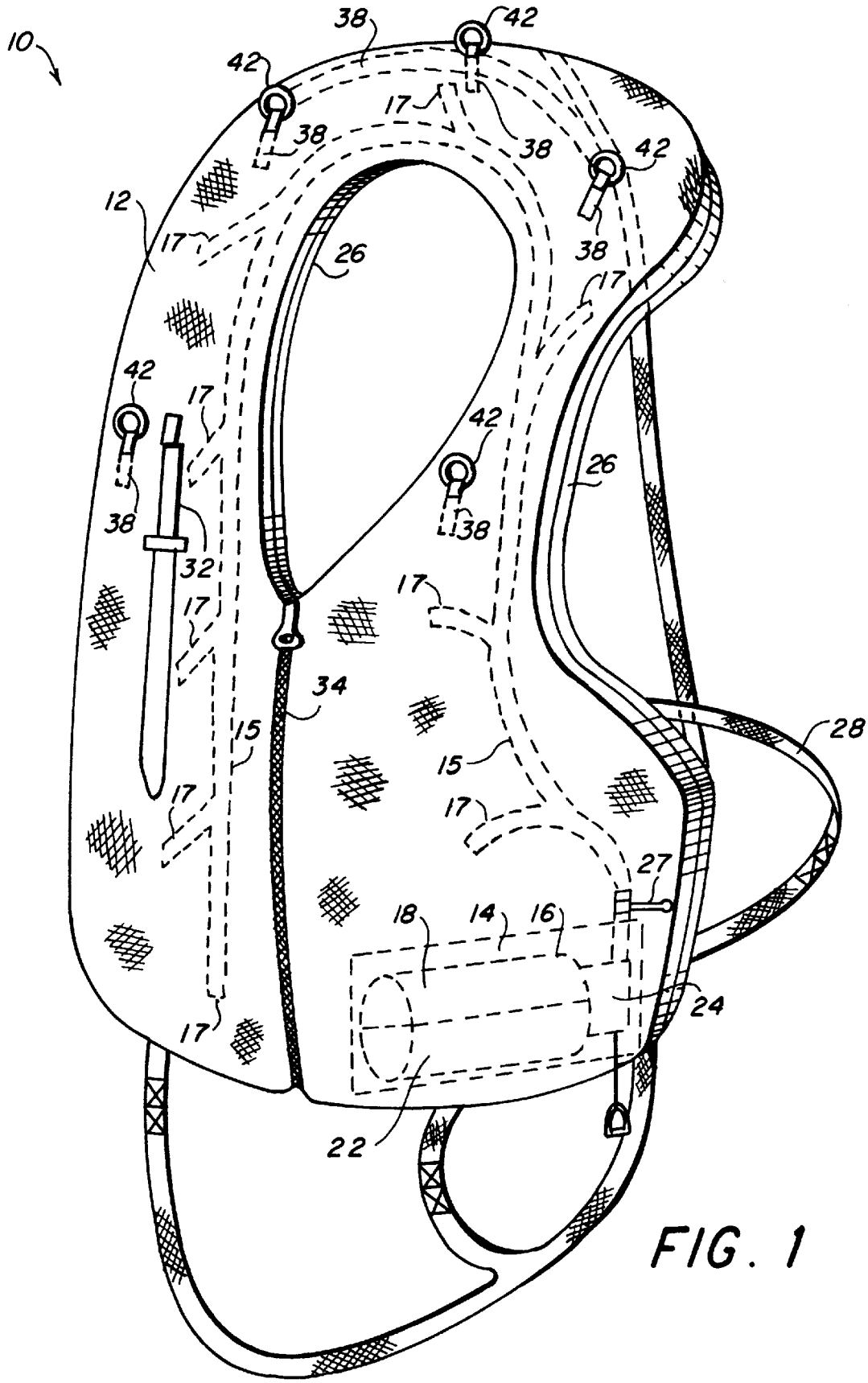
FIG. 1 shows a preferred embodiment of an inflatable, non-collapsible flotation device.

This invention is an inflatable, non-collapsible, flotation device (INCFD) 10, as shown in FIG. 1, and is put on or fitted as is any personal,inflatable device, and then inflated. A buoyancy bag 12 is filled with a foaming chemical, such as polyurethane. Once set, the foam-filled flotation device is as uncollapsible, but much more pliant, as an existing full-time non-collapsible (i.e, solid cork, kapok, etc.) personal flotation device.

The preferred embodiment is comprised of a buoyancy bag 12, a pliant foam dispensing system comprised of a self-contained rigid foam generator 14, comprised of a flask 16 having two internal pressurized cavities 18 and 22, an activation device 24 to activate the flasks 16 pressurized cavities 18 and 22; a thermal blanket 26; and an attachment device 28 for securing the buoyancy bag 12 to a user or object.

The buoyancy bag 12 has one flotation chamber, and is preferably made of a water repellant material, such as a tightly woven coated cotton or a fiber made of a group of synthetic long-chain polymeric amides with recurring amide groups, such as Nylon®. The buoyancy bag 12 flotation chamber begins on the left front of a wearer, passes around the neck of the wearer, and terminates on the right front of the wearer. A zipper, made of plastic or a similar noncorrodable material, is used to join the two sides of the buoyancy bag 12 and assists in the ingress and egress of the wearer. The buoyancy bag 12 is constructed so as to conform to a human body, or other object to be floated. An additional fabric layer 26 closest to the wearer is made of a layer of aluminized polyester film, such as Mylar®, covered by a scuff-resistant woven fabric (such as Nylon®-cotton blend, or cotton for fire retardency) and affixed to the buoyancy bag 12 by sewing or some other appropriate means.

The essential element of this invention is a pliant foam dispensing system 14 which relies generically on a pliant foam to provide buoyancy. The pliant foam, preferably polyurethane, derives when a polyisocyanate $$\text{OCN—R—NCO} \tag{1}$$

reacts with a polyol $$\text{HO—R'—OH} \tag{2}$$

where R is a variable-length string of $CH_2$ units. (Hydrogen atoms are not listed in the formulae, except those which participate in the reaction.) Thus, (A)

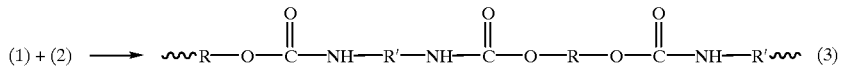

"urethane" linkage reaction

The reaction is catalyzed by such metal salts as butyl-tin-dilaurate, zinc-octoate, or other, more reactive, catalysts. To form a useful foam, the reaction requires a blowing agent (e.g., pentane, hexane or a halogenated material such as methylene chloride, chloro-pentane, chloro-hexane, or $CO_2$, for fire retardency), and a cell (i.e., gas "bubble") stabilizer (e.g., a viscous polyester fluid, silicone fluid, or similar surfactant).

The foam generating system 14, comprises a flask 16 having a first and second pressurized ($CO_2$ or equivalent) cavities 14 and 16, respectfully, having a volume of approximately 30 ml each. The first cavity 18 of the flask 14 is filled with the appropriate polyisocyanate (1), and the second pressurized cavity 22 is filled with polyol (2), a blowing agent (e.g., the fire-resistant cholorohexane), a cell stabilizer (e.g., polyester fluid, or silicone), and a catalyst (e.g., zinc octoate). When activated by the activation system 24 (e.g., a pull cord, or water reactive switch), the liquid reagents (from within cavities 18 and 22) enter the flaccid buoyancy bag 12 via a tubular distribution net 15, react to foam in place, and harden within minutes. The tubular distribution net may be a flexible tube 13 with openings 17 along its length to evenly distribute the pliant foam as it is formed by the chemical reaction to all portions of the buoyancy bag, before the foam solidifies.

It is realized that the foregoing chemical reaction is exothermic. The heat released by the exothermic urethane reaction is shielded from the wearer by a heat reflecting layer of material 26, and further it is likely that the wearer will have several layers of clothing between their skin and the flotation device 10, and also the reagents may be so selected as to minimize the heat production and maintain the final temperatures (those at the reaction point) to no more than 100 to 150 degrees Fahrenheit.

An alternative pliant foam generating system 14, the polyisocyanate (1) reacts with water to give an amine or diamine $$R—NH_2 \tag{4a}$$

or $$H_2N—R—NH_2 \tag{4b}$$

and carbon dioxide which serves as the blowing agent. (It is noted that the self generated blowing agent carbon dioxide is a fire retardant material.) The amine (Eq. 4a and b) reacts with unreacted polyisocyanate (1) to give the desired urethane. This alternative provides its own blowing agent. In this embodiment, the first pressurized cavity 18 of the flask 14 contains the polyisocyanate (1) and the second pressurized cavity 22 of the flask 14 is filled with the water, catalyst, and cell stabilizer. No polyol would be required. The reaction described in this embodiment is less energetic and less exothermic.

In this preferred embodiment, the INCFD 10 stores flat (approximately one inch thick) until needed, then inflates to contain a pliant, non-flammable foam form-fitting device which provides buoyancy and insulation to the wearer. The deflated INCFD 10 in the preferred embodiment is approximately 2 feet by 3 feet, roughly rectangular in shape. The attachment device 28, as shown in FIG. 1, is comprised of straps made of a water repellant material and buckles, allow the user to fasten the INCFD 10 on and secure it prior to inflation via the self-contained pliant foam generator 14 having a safety pressure relief valve 27 to prevent bursting of the buoyancy bag 12, and a mouthpiece 32 as a safety backup to orally inflate the INCFD 10 and operate it as a purely inflatable device if the foam generator 14 fails to properly inflate the buoyancy bag 12. it would be possible, for instance, to inflate the bag orally with air and then deflate it and subsequently activate the foam-filling mechanism.

The INCFD 10 may be stored in a small space or carried in a packaged, minimum-volume form. Because of the materials used and the form of storage for the mixing chemicals, the invention has an excellent storage life. The device may be rapidly inflated from storage to a form-fitting working configuration to provide buoyancy. During inflation, the foaming agent fills the flotation bag, hardens, and forms to the configuration of an individual or object, thereby providing accommodation for complex shapes.

In a second preferred embodiment, the attachment device of the INCFD 20 may consist of the thermal blanket 24 forming a full-body sleeveless vest with a zipper 34 down the front of the buoyancy bag 12 between right and left front portions. This embodiment will provide front and back insulation for the wearer from the water, thereby reducing the possibility of the wearer experiencing hyperthermia. Further, this embodiment will allow the wearer to don and wear the INCFD 20 like a normal item of clothing until a need arises wherein the device need to be activated. Relief from moderate tightness may be achieved by a double zipper 34 system wherein the front of the buoyancy bag 12 may be expanded by having two cloth extensions within the area enclosed by the zipper 34 that are joined the two sides of the cloth extension, or an expandable material 36 may be sewn on either side of the zipper 34 that will expand under pressure and provide relief to the wearer.

In both the first and second preferred embodiments of the INCGD, 10 and 20, respectively, a reinforced belt 38 supporting upper chest lifting rings 42 may be incorporated to facilitate egress from the water by snap-clipping to a descending lifeline (not shown). Because the INCFD, 10 and 20, closely fits the wearer's body and is capable of maintaining its shape under the stress of all weight being carried at these lift points, wearer distress should be minimized while rescue safety is enhanced.

Figure 2:
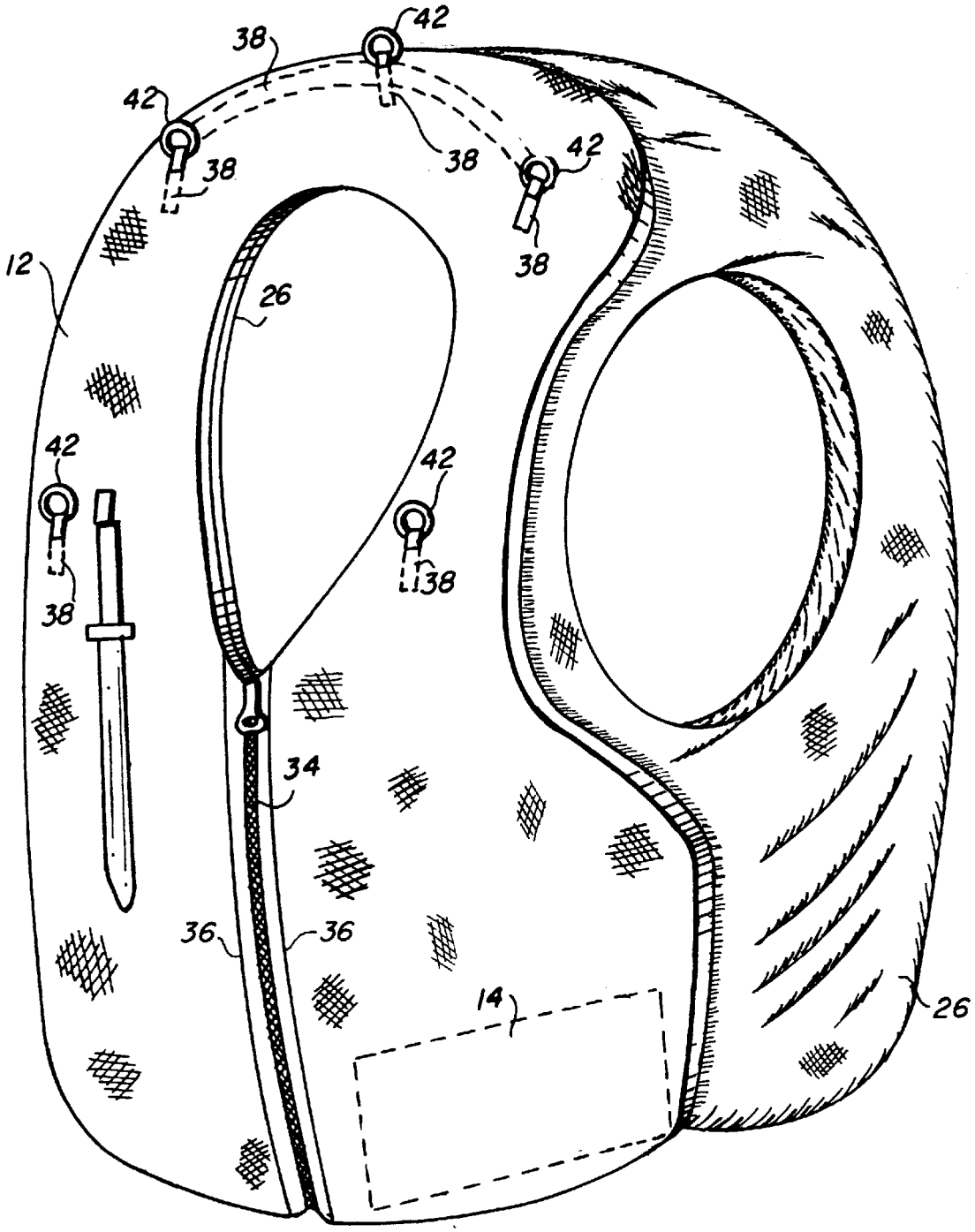
FIG. 2 shows a second preferred embodiment of an inflatable, non-collapsible flotation device.

The INCFD 10 and 20, as shown in FIGS. 1 and 2, combine the best attributes of both the inflatable and non-collapsible systems including storage in a small space and rapid inflation from storage to form-fitting working configuration to provide buoyancy for the wearer. In addition, this invention provides advantages not currently provided by either of the systems. Because of the materials used and the form of storage for the mixing chemicals (in small sealed cylinders) the device has an excellent storage life and will remain available for dependable use for a period of years. The hardened pliant foam offers physical protection from objects, and greater thermal insulation than existing non-inflatable devices because of the close fit to the wearer's body, especially with the body-contact thermal blanket 26. Because of the closed porous bubble spaces an be filled with $CO_2$ produced during the foam formation as part of the chemical reaction scheme, or with an intentionally added non-flammable blowing agent, the INCFD 10 and 20 has a fire retardant character.

Although the invention has been described in relation to the exemplary embodiments thereof, it will be understood by those skilled in the art that other variations and modifications can be affected in the preferred embodiment without detracting from the scope and spirit of the invention as set forth in the claims.

What is claimed is:

1. A flotation device comprising:

a bag made of a tightly woven fiber of a group of synthetic long-chain polymeric amides with recurring amide groups forming a flotation chamber;

means for injecting polyisocyanate (OCN—R—NCO) and polyol (HO—R'—OH) into the bag to form an evenly distributed layer of pliant foam material within the flotation chamber after the chemicals react;

an aluminized polyester film material between said bag and a wearer to protect a user from an exothermic reaction resulting from the chemicals reacting within the bag; and means for attaching the bag to the user.

2. A flotation device, as in claim 1, wherein the attachment means is a water repellant fabric and buckles.

3. A flotation devices comprising:

a bag forming a flotation chamber;

means for injecting a plurality of chemicals into the bag to form an evenly distributed layer of pliant material within the flotation chamber after the chemicals react;

an aluminized polyester film material between said bag and a wearer to protect the wearer from an exothermic reaction resulting from the chemicals reacting within the bag; and means for attaching the bag to the user.

4. A flotation device comprising:

a bag forming a flotation chamber;

means for injecting a plurality of chemicals into the bag to form an evenly distributed layer of pliant material within the flotation chamber after the chemicals react;

an aluminized polyester film material between said bag and a wearer to protect the wearer from an exothermic reaction resulting from the chemicals reacting within the bag;

means for attaching the bag to the user; and a tubular distribution device with openings at preselected points along the tubular device that evenly distribute the rigid foam precursor material generated by the chemical reaction within the flotation chamber.

5. A flotation device comprising:

a bag forming a flotation chamber;

means for injecting a plurality of chemicals into the bag to form an evenly distributed layer of pliant material within the flotation chamber after the chemicals react;

an aluminized polyester film material between said bag and a wearer to protect the wearer from an exothermic reaction resulting from the chemicals reacting within the bag;

means for attaching the bag to the user; and means for attaching an external rescue device to the bag for lifting the user.

6. A flotation device comprising:

a bag forming a flotation chamber;

means for injecting a plurality of chemicals into the bag to form an evenly distributed layer of pliant material within the flotation chamber after the chemicals react;

an aluminized polyester film material between said bag and a wearer to protect the wearer from an exothermic reaction resulting from the chemicals reacting within the bar;

means for attaching the bag to the user; and a metallic ring attached to the bag for lifting the user.

7. A flotation device comprised of:

a water repellant bag forming a flotation chamber;

means for mixing chemical reagents into the bag to form a pliant foam;

means for distributing the pliant foam formed by the mixing of the chemical reagents equally to all portions of the flotation chamber;

an aluminized polyester film between said bag and a user to protect the user from an exothermic reaction of the polyurethane precursor;

means for securing the bag to a user; and means for attaching an external rescue device to the bag for lifting the user.

8. A flotation device, as in claim 7, wherein the means for distributing the pliant foam is a tube of a predetermined length having openings at predetermined intervals along its length for injecting the pliant foam formed by the mixing of the chemical reagents evenly within the flotation chamber.

9. A flotation device, as in claim 7, wherein the means for securing the bag to a wearer is a series of straps.

10. A flotation device, as in claim 7, wherein the means for securing the bag to a wearer is a vest sewed onto the water repellant bag.

11. A method for providing buoyancy to an object comprising the steps of:

injecting polyisocyanate (OCN—R—NCO) and polyol (HO—R'—OH) into a bag made of a tightly woven fiber of a group of synthetic long-chain polymeric amides with recurring amide groups so as to form a pliant foam when the chemicals react thereby filling the bag with a pliant, uncollapsable foam; and placing an aluminized polyester film material around the bag to protect the object from an exothermic reaction resulting from the chemicals reacting within the bag.

* * * * *